United States Patent [19]

Kar

[11] Patent Number: 4,810,199

[45] Date of Patent: Mar. 7, 1989

[54] SAFETY ELECTRICAL PLUG

[76] Inventor: Kishore K. Kar, 4616 Oakridge Dr., Midland, Mich. 48640

[21] Appl. No.: 125,251

[22] Filed: Nov. 25, 1987

[51] Int. Cl.[4] ..... H01R 13/44

[52] U.S. Cl. ..... 439/141; 439/588

[58] Field of Search ..... 439/135–138, 439/141, 149, 367, 528, 892

[56] References Cited

U.S. PATENT DOCUMENTS

| | | | |
|---|---|---|---|
| 2,458,153 | 1/1949 | Festge | 439/588 |
| 2,506,979 | 5/1950 | Varnum | 439/141 |
| 2,755,449 | 7/1956 | Anderson | 439/141 |
| 2,759,160 | 1/1955 | Kelley | 339/75 |
| 3,449,706 | 6/1969 | Carissini | 439/141 |
| 3,683,315 | 8/1972 | Kelley | 439/141 |
| 3,982,084 | 9/1976 | Cooperstein | 339/40;42 |
| 4,340,267 | 7/1982 | Nukaga | 339/42 |
| 4,391,481 | 7/1983 | Golden | 439/141 |

OTHER PUBLICATIONS

Hubbell Wiring Devices Kellems Products, Catalog #35, Date not known but this reference is believed to be Prior Art, p. C12 and G34.

Bryant Wiring Device Catalog BDB 1501, Date not known but this reference is believed to be Prior Art, pp. I14 and I15.

*Primary Examiner*—Paula A. Austin

*Attorney, Agent, or Firm*—Edward E. Schilling; Timothy S. Stevens

[57] ABSTRACT

An improved electrical plug household use to protect household occupants from electrical shocks while inserting or removing the plug from an electrical receptacle. The plug, in general, is a standard household electrical plug with or without a ground prong. The improvement of the present invention is to mount an elastically collapsible electrically insulating hood on the plug surrounding the prongs so that when the improved plug is inserted more than half way into the household electrical receptacle, the extent of the prongs not yet within the receptacle is surrounded by the hood and inaccessible to contact by household occupants, especially children. The hood can be a plastic bellows integrally molded with the body of the plug or the hood can be formed separatly and glued to the body of the plug. The hood can also be a foamed polymer tube section glued to the body of the plug.

13 Claims, 2 Drawing Sheets

SAFETY ELECTRICAL PLUG

FIELD OF THE INVENTION

The present invention is in the field of household electrical plugs and more particularly, in the field of electrical plugs which offer increased protection for the occupants of the household from electrical shocks while inserting or removing the plugs from electrical receptacles.

BACKGROUND OF THE INVENTION

Children can sometimes play with the conventional electrical outlets and plugs found in the home. In this play, the child can stick his or her fingers, tongue or other body parts near a plug partially inserted into an electrical outlet and make contact with the prongs of the plug, exposing the child to the severe electrical shock of line voltage. Such a shock can injure and possibly kill the child. Adults as well face a shock hazard when using conventional electrical plugs in the home, e.g., when inserting a plug into a receptacle by touch in the dark or around an obstacle. Many devices have been developed to protect children and adults from these hazards.

In U.S. Pat. No. 4,531,800 to Avener, a device is attached to an electrical outlet and plug to prevent children from pulling out the plug. The invention of this patent is believed to be effective but requires the installation of a special wall receptacle or receptacle cover plate. In U.S. Pat. No. 3,982,084 to Cooperstien, a specially modified electrical receptacle is described wherein electrical contact with the prongs of the plug is not made until the plug is fully inserted into the receptacle. The invention of this patent is also believed to be effective but requires the installation of a special receptacle and the use of a non-standard plug having an additional non-conducting prong which cooperates with the special receptacle. U.S. Pat. No. 4,340,267 to Nakuga, describes a plug having a spring-loaded prong covering member. The prongs of the plug extend through the prong covering member exposing a shortened section of the tip of each prong. When the plug is inserted into a receptacle, the prong covering member is automatically retracted in such a way that the exposed portions of the prongs are covered when the plug is partially inserted into the receptacle. The invention of this patent does not require the replacement of the standard household electrical receptacle and is believed to be effective. However, its construction involves a number of parts which is believed to increase its cost of manufacture.

SUMMARY OF THE INVENTION

The present invention is an improved safety electrical plug for household use. The plug, in general, is a standard household electrical plug with or without a ground prong and thus comprises an electrically insulating body, such as a body made of phenolic resin, which encases at least two conventional spaced apart electrically conducting prongs, such as copper alloy prongs, extending a preselected length outwardly from one, usually flat, face of the body, the prongs being substantially parallel with each other and of equal length and designed to be connected to respective electric leads from, e.g., a conventional electrical cord. The improvement comprises an elastically collapsible electrically insulating circumferential hood or sleeve having a first end and a second end, the first end of the hood being immovably attached to the body of the plug and the second end being open and unattached. The hood laterally surrounds the prongs and the second end of the hood extends at least about one half the outwardly extending length of the prongs. The hood also is substantially coaxial with the prongs and is collapsible in the direction of the longitudinal axes of the prongs at least one half of the outwardly extending length of the prongs. The end result is that when the improved plug is inserted more than at least one half of the outwardly extending length of the prongs into a household electrical receptacle, the extent of the prongs not yet within the receptacle is substantially covered or surrounded by the hood and inaccessible to ready contact by household occupants. The hood can be pleated or bellows shaped and can be integrally molded with the body of the plug as a unit of durable synthetic resinous material, such as a polyolefin plastic. Alternatively, the hood can be formed of a foamed polymer material, such as foamed natural rubber, foamed synthetic rubber or foamed polyurethane. In either event the hood can be cemented to the plug body adjacent the perimeter about the face from which the prongs extend and preferably the body can be recessed or stepped to accommodate the collapsed hood within the recess or along the step.

Another aspect of the invention is an elastically collapsible electrically insulating hood having a first end, which is coated with a pressure sensitive adhesive, and a second end. The distance between the first end and the second end of the uncollapsed free standing hood being more than about 0.2 inches and less than about 1 inch. The first end of the hood is coated with the pressure sensitive adhesive so that the first end of the hood can be adhesively bonded to a conventional household electrical plug with the prongs of the plug circumferentially surrounded by the hood. This aspect of the present invention allows the retrofitting of a conventional electrical household plug into a safety plug of the present invention having the benefits described in the preceeding paragraph.

Yet another aspect of the present invention is an elastically collapsible electrically insulating hood having a first end, which is immovably attached to a face plate, and a second end. The distance between the first end and the second end of the uncollapsed free standing hood being more than about 0.2 inches and less than about 1 inch. The face plate defines at least two perforations therethrough configured so that at least two of the prongs of a conventional household electrical plug can be passed through the at least two perforations and be circumferentially surrounded by the hood. This aspect of the present invention also allows the retrofitting of a conventional electrical household plug into a safety plug of the present invention having the benefits described in the second paragraph preceeding this one.

DETAILED DESCRIPTION OF THE INVENTION

Figure 1:
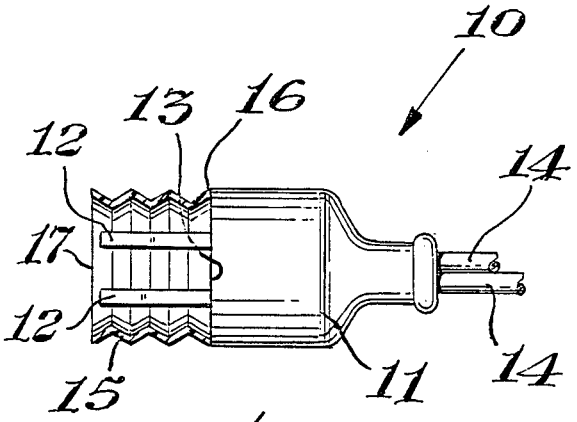
FIG. 1 is a top view, partly in full and partly in section, of an embodiment of the present invention showing a bellows type hood surrounding the prongs of the plug.

Referring now to FIG. 1, therein is shown a household safety electrical plug of the present invention identified generally by the reference numeral 10. The plug 10 comprises an electrically insulating body 11 which serves as a casing for two spaced apart electrically conducting prongs 12 which extend a preselected length outwardly from one face 13 of the body 11, the prongs 12 being substantially parallel and substantially of equal length with each other as is conventional for household electrical plugs. Each prong 12 is connected within the interior of the body 11 to a bare or stripped portion of a respective insulated electric lead 14 and elements 11–14 describe many conventional electric plugs. FIG. 1 also shows a round bellows-shaped elastically collapsible electrically insulating hood 15 having a first end 16 and a second end 17. The first end 16 of the hood 15 is immovably attached to the body 11 by molding the hood 15 and the body 11 together as a unit of a synthetic resinous material such as a polyvinylchloride resin, a thermoset elastomer, or a thermoplastic elastomer.

Figure 2:
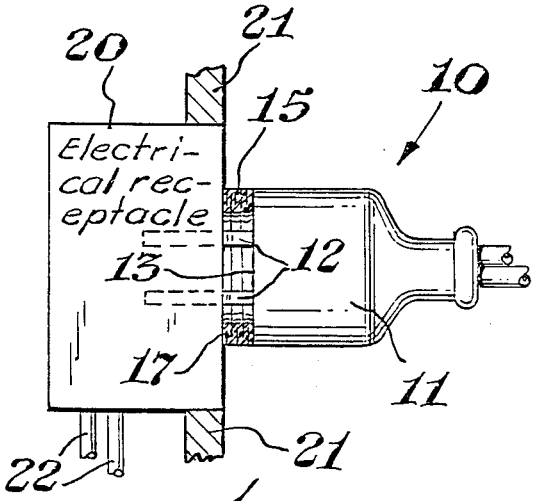
FIG. 2 is a top view, partly in full, partly in section and partly schematic, showing the embodiment of FIG. 1 inserted into a household electrical receptacle.

Referring now to FIG. 2, therein is shown the plug 10 of FIG. 1 inserted into a household electrical wall receptacle 20. The wall receptacle 20 is shown mounted in a wall 21. Electrical leads 22 are shown emerging from the receptacle 20. The hood 15 is shown fully collapsed in the direction of the longitudinal axes of the prongs 12 more than one half the outwardly extending length of the prongs 12, i.e., the first end 17 of the hood 15 has moved back more than one half the outwardly extending length of the prongs 12 from the position shown in FIG. 1 to the position shown in FIG. 2. It is apparent that when the plug 10 is inserted any length of the prongs 12 into a household electrical receptacle, the portions of the prongs 12 not within the receptacle are substantially covered by the hood 15. In FIG. 2, it may be seen that the face 13 of the body 11 is not flush with the receptacle 20 because of the intervening collapsed bellows of the hood 15 which continue to surround the base end of the prongs and leave substantially no crevice between the plug and receptacle.

Figure 3:
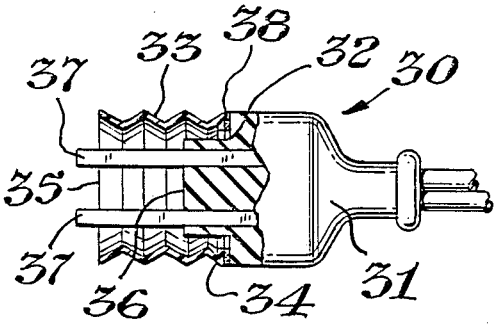
FIG. 3 is a top view, partly in full and partly in section, of another embodiment of the present invention showing the hood attached to a perimeter step formed in the body of the FIG. 4 is a bottom view, partly in full and partly in section, of another embodiment of the present invention showing the hood attached in a recess formed in the body of the plug.

Referring now to FIG. 3, therein is shown another household electrical plug of the present invention identified generally by the reference numeral 30. The body 31 of the plug 30 defines an annular step 32 formed in the periphery of the face 36 of the body 31. FIG. 3 also shows a round bellows-shaped elastically collapsible electrically insulating hood 33 having a first end 34 and a second end 35. The first end 34 of the hood 33 is immovably attached to the body 31 by bonding with an adhesive agent 38 such as a urethane adhesive or an acrylic adhesive and the second end being free and open. The hood 33 can be made of almost any flexible electrically insulating material such as flexible, non-conducting synthetic or natural polymers. When the plug 30 is fully inserted into a household electrical receptacle, the hood 33 can collapse along the step 32 so that the face 36 is flush with the receptacle. The second end 35 of the hood 33 extends almost but not quite the outwardly extending length of prongs 37 to facilitate the initial visual alignment of the prongs 37 with a receptacle.

Figure 4:
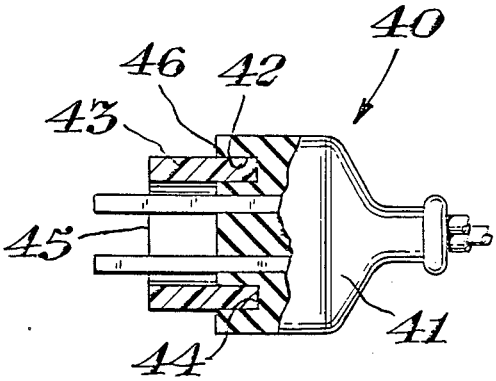

Referring now to FIG. 4, therein is shown another household electrical plug of the present invention identified generally by the reference numeral 40. The body 41 of the plug 40 defines an annular recess 42 adjacent the periphery of the face 46 of the body 41. FIG. 4 also shows a tube shaped electrically insulating foamed polymer hood 43 having a first end 44 and a second end 45. The first end 44 of the hood 43 is immovably attached to the body 41 by any suitable means, preferably by adhesive bonding, while the second end is free and open. The hood 43 can be formed of foamed rubber, foamed polyurethane, or most any other elastically collapsible foamed polymer material that is also an electrical insulator. When the plug 40 is fully inserted into an interior household electrical receptacle, the hood 43 can collapse within the recess 42 so that the face 46 is flush with the receptacle. The second end 45 of the hood 43 as shown here extends a bit more than one half of the outwardly extending length of prongs 47 to better facilitate the initial visual alignment of the prongs 47 with a receptacle. However, it is more preferable for the second end of the hood to extend at least two thirds of the outward extent of the prongs of the plug so that there is almost no chance that a person could contact the energized prongs of a plug partially inserted into a receptacle since most plugs become energized, i.e., the prongs of the plug begin to carry line voltage, when the prongs are inserted about one third of their outwardly extending length into a receptacle. The hood can also be made of a clear or substantially transparent material as an aid in visually aligning the prongs with a receptacle.

Figure 5:
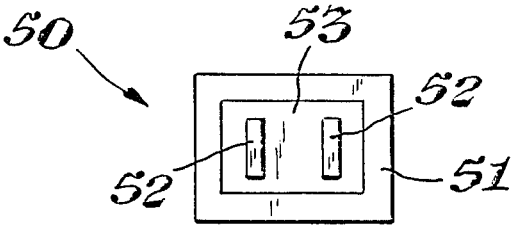
FIG. 5 is an end view of another embodiment of the present invention showing the prongs extending from an end face and surrounded by a rectangular hood.

Referring now to FIG. 5, therein is sbown another household electrical plug of the present invention identified generally by the reference numeral 50 having a rectangular hood 51 surrounding prongs 52 extending from face 53. It should be understood that the hood of the present invention can be round, rectangular, square, triangular, oval or most any other shape when viewed end-on as in FIG. 5.

Figure 6:
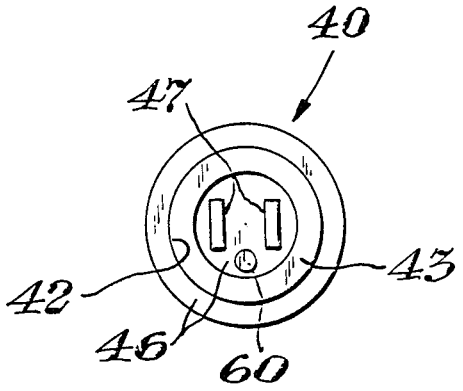
FIG. 6 is an end view of the embodiment of the present invention shown in FIG. 4, but here viewed in the direction of the axes of the prongs and showing additionally a ground prong not visible in the sectional view as shown in FIG. 4.

Referring now to FIG. 6, therein is shown an end view of the plug 40 of FIG. 4 and additionally showing a ground prong 60 that together with prongs are surrounded by hood 43.

Figure 7:
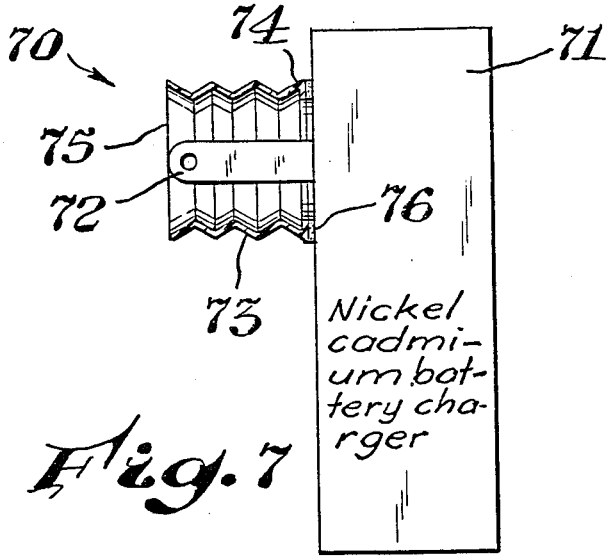
FIG. 7 is a side view, partly in full, partly in section and partly schematic, of another embodiment of the present invention showing a hood adhesively bonded to a plug body which is integrally formed with a battery charger.

Referring now to FIG. 7, therein is shown another embodiment of the present invention identified generally by the reference numeral 70. The body 71 of the embodiment 70 is schematically represented to be a nickel cadmimum battery charger having an electrical plug integrally formed therewith including prong 72.

Another example of a household appliance having a plug body integrally formed with the body of the appliance is a nightlight that plugs directly into a receptacle. A round bellows-shaped elastically collapsible electrically insulating hood 73 having a first end 74 and a second end 75 is also shown in FIG. 7. The first end 74 of the hood 73 is immovably attached to the body 71 by pressure sensitive adhesive 76 and the second end of the hood 75 being free and open. The hood 73 can be made of almost any flexible electrically insulating material such as flexible, non-conducting synthetic or natural polymers. The pressure sensitive adhesive 76 makes it easy to retrofit the hood 73 to the body 71 as shown or to almost any other form of conventional household electrical plug by for example removing a protective paper strip from the pressure sensitive adhesive 76 and then pressing the first end 74 of the hood 73 against the face of the plug as shown. Preferably, the distance between the first end 74 and the second end 75 of the hood 73 is more than about 0.2 inch and less than about 1 inch for an uncollapsed free standing hood 73.

Figure 8:
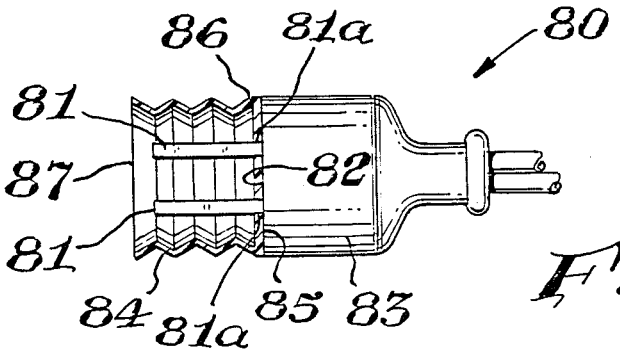
FIG. 8 is a top view, partly in full and partly in section, of another embodiment of the present invention showing a hood integrally formed with a plug body face plate.

Referring now to FIG. 8, therein is shown another household electrical plug of the present invention identified generally by the reference numeral 80. The plug 80 comprises prongs 81 extending from a face 82 of the body 83 of the plug 80. A round bellows-shaped elastically collapsible electrically insulating hood 84 having a first end 86 and a second end 87 is shown integrally molded to a perforated body face plate 85 having prong-receiving perforations therethrough 81*a*. It should be understood that for the purposes of the present invention, a perforated body face plate, such as the perforated body face plate 85 shown in FIG. 8, is considered to be a part of the body of a plug and attaching a hood of the present invention to a perforated body face plate is equivalent to attaching such a hood directly to the body of a plug. The combination of the hood 84 and the perforated body face plate 85 makes it easy to retrofit almost any conventional household electrical plug by slipping the prongs 81 of such a plug through the perforations 81*a* of the perforated body face plate 85. Of course, the hood 84 could have been formed separately from the perforated body face plate 85 and then the two parts attached to each other by for example adhesive bonding or mechanical interlocking such as a snap joint or a Velcro brand joint. Preferably, the distance between the first end 86 and the second end 87 of the hood 84 is more than about 0.2 inch and less than about 1 inch for an uncollapsed free standing hood 84.

For the purposes of the present description and the claims, the term "elastically collapsible" means that when a plug of the present invention is removed from a household electrical receptacle, the hood expands longitudinally so that the second end of the hood assumes a position substantially at least one half the outward length of the prongs of the plug. Preferably, this expansion occurs promptly while removing the plug from the receptacle so that there is almost no chance that a person could contact any energized prongs of the plug.

Critically, the hood must be made of an electrically insulating material. However, it should be understood that a hood comprising a metallic wire coil or other electrically conducting spring which is enveloped with an electrically insulating material is meant to be an embodiment of the present invention even though not presently contemplated as a preferred embodiment.

A bellows-shaped hood may be molded or otherwise formed with a series of ribs, or ridges and valleys, being sinusoidal-like or zig-zag-like in section, or the hood may have a continuous spiral rib or flight so that each surface is similar to the surface of a threaded bolt, the inner and outer surfaces being, of course, complementary. The hood may be of uniform diameter if desired, although that is not essential. The hood may have a somewhat smaller diameter at one end than the other in the event that it is easier to manufacture by some molding operation.

The term "household electrical receptacle" means a standard two pole, two wire receptacle as found in many older homes or a standard two pole, three wire receptacle as found in most newer homes, which receptacles are structurally similar to the NEMA 1-15R or 5-15R configurations as to prong receiving openings. In addition, of course, the term "household electrical receptacle" means an extension cord receptacle having prong-receiving openings configured similarly to the NEMA 1-15R or 5-15R receptacles and other such configured receptacles.

The plugs 10, 30 and 40 of FIGS. 1, 2, 3, 4, and 6 are all of the permanently assembled type, i.e., the leads and prongs are molded into the body of the plug. It should be understood, however, that the present invention is also applicable to plugs wherein the leads are removably connected to the prongs, e.g., replacement type plugs.

Among the advantages of the safety plug of the present invention is that it is amenable to low cost manufacturing in which the plug body and protective collapsible hood are integrally molded or separately formed. Additionally, the safety plug of the present invention does not spoil the decor of the home and makes the plug water resistant and electrically shock resistant to contact with metal pins or probes of any sort.

What is claimed is:

1. In a household safety electrical plug comprising an electrically insulating body serving as a conductor casing and at least two spaced apart electrically conducting prongs extending a preselected length outwardly from one face of the body, the prongs being substantially parallel and substantially of equal length with each other, wherein the improvement comprises: an elastically collapsible electrically insulating circumferential hood having a first end and a second end, the first end of the hood being immovably attached to the body, the hood laterally surrounding the prongs, the second end of the hood extending at least about one half the outwardly extending length of the prongs, the hood being substantially coaxial with the prongs, the hood being elastically collapsible in the direction of the longitudinal axes of the prongs at least one half of the outwardly extending length of the prongs so that when the plug is inserted more than at least one half of the outwardly extending length of the prongs into a household electrical receptacle, the exposed portions of the prongs are subtantially covered by the hood, the hood being dimensioned to collapse substantially within a space projected in the normal direction from the face of the body of the plug from which the electrically conducting prongs extend such that the body is not flush with the receptacle.

2. The plug of claim 1 wherein the second end of the hood extends at least about two thirds of the outwardly extending length of the prongs so that when the plug is inserted more than at least one third of the outwardly extending length of the prongs into a household electrical receptacle, the exposed portions of the prongs are substantially covered by the hood.

3. The plug of claim 1 wherein the second end of the hood extends at least about the outwardly extending length of the prongs so that when the plug is inserted about any length of the prongs into a household electrical receptacle, the exposed portions of the prongs are substantially covered by the hood.

4. The plug of claim 1 wherein the hood comprises a foamed polymer material.

5. The plug of claim 1 wherein the body defines a step, the step being formed in the periphery of the face of the body from which the prongs extend, the first end of the hood being positioned in and attached to the body in the step so that when the plug is fully inserted into a household electrical receptacle, the hood can collapse along the step.

6. The plug of claim 1 wherein the hood is bellows-shaped.

7. The plug of claim 6 wherein the hood and the body are integrally molded as a unit of synthetic resinous material.

8. The plug of claim 1 wherein the first end of the hood is adhesively bonded to the body of the plug.

9. The plug of claim 8 wherein a pressure sensitive adhesive is used to adhesively bond the first end of the hood to the body of the plug.

10. In a household safety electrical plug comprising an electrically insulating body serving as a conductor casing and at least two spaced apart electrically conducting prongs extending a preselected length outwardly from one face of the body, the prongs being substantially parallel and substantially of equal length with each other, wherein the improvement comprises: an elastically collapsible electrically insulating circumferential hood having a first end and a second end, the first end of the hood being immovably attached to the body, the hood laterally surrounding the prongs, the second end of the hood extending at least about one half the outwardly extending length of the prongs, the hood being substantially coaxial with the prongs, the hood being elastically collapsible in the direction of the longitudinal axes of the prongs at least one half of the outwardly extending length of the prongs so that when the plug is inserted more than at least one half of the outwardly extending length of the prongs into a household electrical receptacle, the exposed portions of the prongs are substantially covered by the hood and wherein the body defines a peripheral recess, the recess positioned in the face of the body from which the prongs extend, the first end of the hood positioned within and attached to the body in the recess so that when the plug is fully inserted into a household electrical receptacle, the hood can collapse substantially within the recess.

11. An elastically collapsible electrically insulating sleeve-like hood having a first end and a second end, the first end being immovably attached substantially normal to and aligned with a face plate of closely similar transverse dimensions, the length of the hood between the first end and the second end of the uncollapsed free standing hood being more than about 0.2 inch and less than about 1 inch, the face plate having at least two perforations therethrough configured so that a conventional household electrical plug having a body and at least two prongs can be passed through the at least two perforations until the face plate substantially lies against the plug body whereupon the prongs are circumferentially surrounded by the hood over at least about one-half of the length of the prongs, the hood being dimensioned to collapse substantially within a space projected in the normal direction from one face of the face plate such that the body is not flush with the faceplate.

12. The hood and face plate of claim 11 wherein the hood and face plate are integrally molded together as a unit of synthetic resinous material.

13. The hood and face plate of claim 12 wherein the hood is bellows-shaped.

* * * * *